US005428898A

United States Patent [19]

Hawkins

[11] Patent Number: 5,428,898

[45] Date of Patent: Jul. 4, 1995

[54] PIZZA CUTTER

[75] Inventor: Howard C. Hawkins, Mahtomedi, Minn.

[73] Assignee: Bicycle Tools Incorporated, St. Paul, Minn.

[21] Appl. No.: 169,980

[22] Filed: Dec. 17, 1993

[51] Int. Cl.[6] ..... B26B 29/00

[52] U.S. Cl. ..... 30/295; 30/298.4; 30/319

[58] Field of Search ..... 30/307, 319, 347, 298.4, 30/295; D7/694

[56] References Cited

U.S. PATENT DOCUMENTS

| | | | |
|---|---|---|---|
| 900,300 | 10/1908 | Nicolas | 30/319 |
| 1,339,397 | 5/1920 | Jones | 51/221 |
| 4,809,437 | 3/1989 | Saliaris | 30/319 |
| 4,858,266 | 8/1989 | Engstrom | 15/111 |

OTHER PUBLICATIONS

Bike Nashbar, Nov. 1993, p. 87.

*Primary Examiner*—Richard K. Seidel
*Assistant Examiner*—Jay A. Stelacone
*Attorney, Agent, or Firm*—Palmatier, Sjoquist & Helget

[57] ABSTRACT

The present pizza cutter of a unique design has a circular blade mounted in a fork on the forward end of an arch-shaped frame. The intermediate portion of the frame is a handle for holding the pizza cutter. The arched shape of the handle prevents the hand from contacting the pizza during cutting. The handle has a thumb guide for applying pressure to cut the pizza, a thumb guard for preventing the thumb from contacting the blade, and a fender to protect the hand from contacting the blade. The rearward end of the frame is a support for supporting the pizza cutter in a vertical position on a horizontal surface when not in use. The blade is attached to the frame by a hub between the tines of the fork, thereby preventing the blade from wobbling during cutting. The pizza cutter also has a stand adapted to receive the blade and support.

19 Claims, 2 Drawing Sheets

PIZZA CUTTER

BACKGROUND OF THE INVENTION

Cutting pizza into slices for human consumption requires a tool adapted for rapid cutting and for applying varying amounts of pressure to the pizza, depending on the consistency of the toppings and the thickness of the crust.

Currently, pizza is cut by either an ordinary knife or by a specialized tool adapted for cutting pizza, i.e., a pizza cutter. Such pizza cutters typically comprise a circular blade attached to a handle of a generally rectangular shape. The blade is attached to the handle by an axle, and rotates in a plane perpendicular to the surface of the pizza. The circular blade thus forms a cutting wheel which allows the operator to cut the pizza by rolling the cutting wheel across the pizza while applying downward pressure. The angle at which the handle is positioned relative to the pizza is variable, thus allowing varying amounts of pressure to be applied to the pizza, accommodating various topping consistencies and crust thicknesses.

Typical pizza cutters do not have shields to protect the thumb or fingers from the blade, and the thumb or fingers may thus contact the blade, particularly when the handle is slippery due to contact with dough, flour, cheese, sauce and toppings.

Typical pizza cutters also do not have a shield to prevent the hand from contacting the pizza, such contact may result when the angle between the handle and the pizza is small.

Typical pizza cutters are not self-supporting, so that the cutter must be laid flat on a horizontal surface, which is often coated with flour, dough, cheese, and toppings, thus increasing the likelihood of injury to the hand because of the slipperiness of the handle.

In most pizza cutters the blade is free to wobble slightly from side to side during the cutting process, reducing efficiency and sometimes producing an uneven cut.

SUMMARY OF THE INVENTION

The present invention is a pizza cutter of a unique design which has a circular blade mounted in a fork on the forward end of an arch-shaped frame. The intermediate portion of the frame is a handle for holding the pizza cutter. The arched shape of the handle prevents the hand from contacting the pizza during cutting. The handle has a thumb guide for applying pressure to cut the pizza, a thumb guard for preventing the thumb from contacting the blade, and a fender to protect the hand from contacting the blade. The rearward end of the frame is a support for supporting the pizza cutter in a vertical position on a horizontal surface when not in use. The blade is attached to the frame by a hub between the tines of the fork, thereby preventing the blade from wobbling during cutting. The pizza cutter also has a stand adapted to receive the blade and support.

An advantage of the invention is that the arched shape of the handle keeps the hand removed from the surface of the pizza, even when the cutter is being operated close to the surface of the pizza. The hand is thus kept clean of sauce, cheese and toppings. In addition to the aesthetic and health reasons for keeping the hand clean, keeping the hand clean increases the safety of the cutting operation by preventing the hand from slipping along the handle and contacting the blade.

To further increase the safety of the operator, the invention includes an arch-shaped fender between the hand and the blade and a thumb guard to prevent the thumb from slipping forward off the thumb guide and contacting the blade.

Another advantage of the invention is that it is capable of being stood upright on a horizontal surface, thus keeping the pizza cutter free of sauce, cheese and toppings which frequently clutter the cutting surface. This further decreases the likelihood of the hand becoming coated with pizza ingredients and slipping along the handle to contact the blade. The support at the rearward end of the cutter also serves as a shield to prevent the hand from contacting the pizza.

Another advantage of the invention is that the circular blade is rigidly constrained against lateral motion during cutting by being mounted between the tines of a fork on the forward end of the frame. The mounting is achieved by forming a hub around the mounting hole in the blade with the hub abutting the tines of the fork. The hub rotates against the tines with some friction. Although the blade is free to rotate in a vertical plane perpendicular to the surface of the pizza, the relationship between the hub and the fork prevents any wobbling of the blade from side to side. This results in greater cutting efficiency and a uniform cut.

DETAILED DESCRIPTION OF THE PREFERRED EMBODIMENTS

One embodiment of the pizza cutter is shown in FIGS. 1–4 and is identified as numeral 8.

This embodiment of the invention comprises an arcuate frame 10 upon which a circular blade 12 is rotatably mounted at the forward end so that the blade is free to rotate in a plane perpendicular to the surface of the pizza 14 to be cut.

Figure 4:
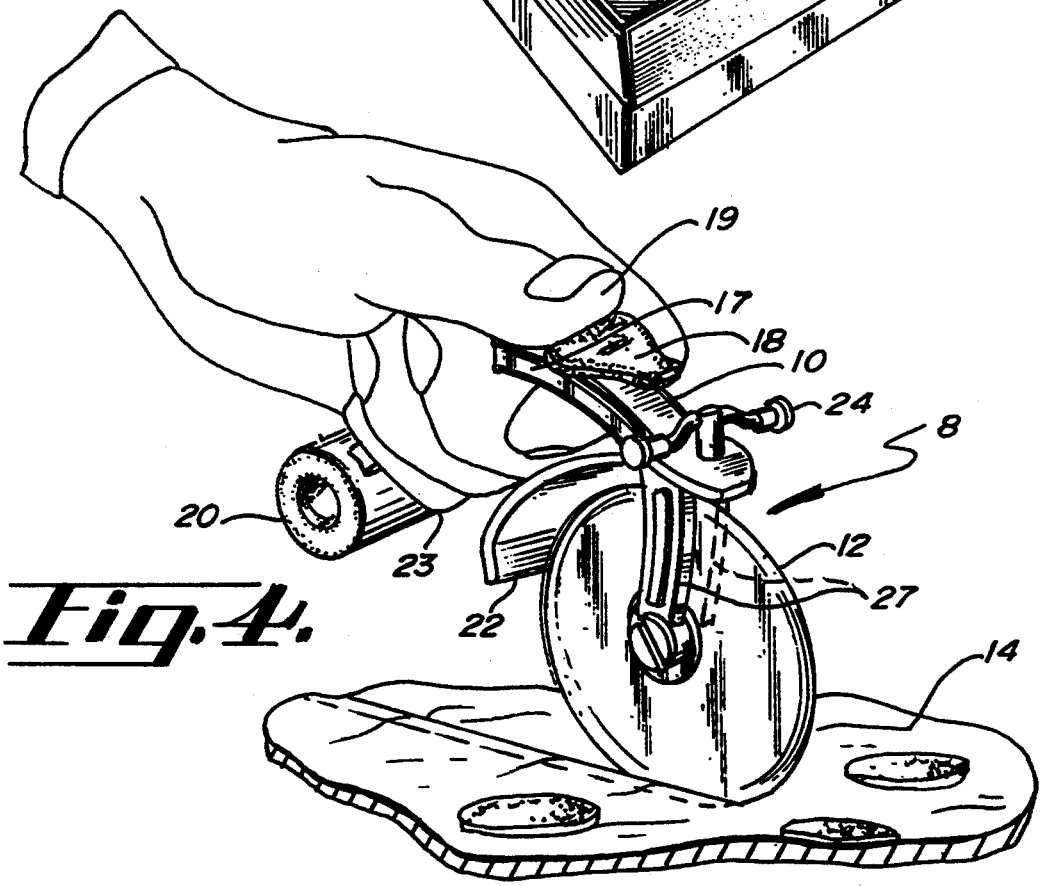
FIG. 4 shows the invention in operation cutting a pizza.

The arcuate frame 10 has an intermediate portion 16 forming a handle 17 for gripping by a human hand, as most clearly shown in FIG. 4.

A thumb guide 18 attached to or integrated with the handle 17 allows the thumb 19 to guide the pizza cutter 8 when cutting and apply downward pressure, thus forcing the blade 12 against the pizza 14 for cutting.

A support 20 is attached to or integrated with the rearward end 21 of the frame 10 allowing the pizza cutter 8 to stand vertically on a horizontal surface 15 by resting on an arc of the blade 12 and the support 20. This prevents contamination of the pizza cutter 8 with pizza ingredients which are generally found in the area of the horizontal surface where the pizza is being cut. The support 20 may be of any shape which serves to support the pizza cutter 8, and is preferably of a cylindrical cross-section with the axis of the cylinder perpendicular to the longitudinal axis of the frame 10.

The pizza cutter 8 has a number of features designed for the safety of the operator. First, the frame 10 has a fender 22 attached to it or integrated with it, the fender 22 being an arcuate structure with a radius approximately that of the circular blade 12. The fender 22 is positioned between the blade 12 and the hand 23 as the hand grips the handle 17, thus shielding the hand 23 from the blade 12.

The handle 17 also has a thumb guard 24, which may be attached to or integrated with the fender 22, positioned forward of the thumb guide 18 in such a manner as to prevent the thumb 19 from slipping forward and downward and contacting the blade 12.

The support 20 also acts as a hand shield, preventing the hand 23 from contacting the surface of the pizza 14 when the pizza cutter 8 is being operated at an angle which causes the rearward end 21 of the pizza cutter 8 to be close to the pizza 14, as is most clearly seen in FIG. 4.

Figure 2:
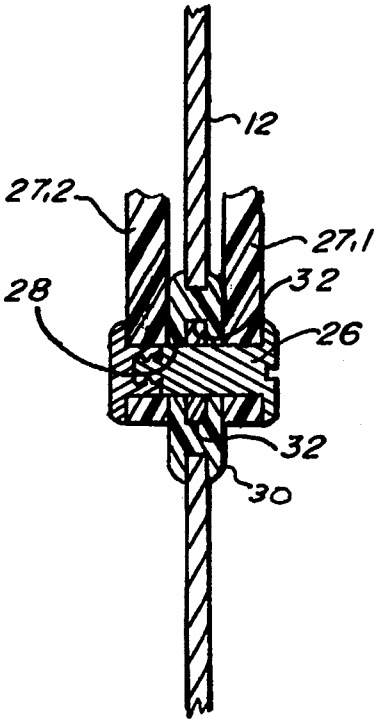
FIG. 2 is a cross-sectional view taken along the line 2—2 in FIG. 1.
Figure 1:
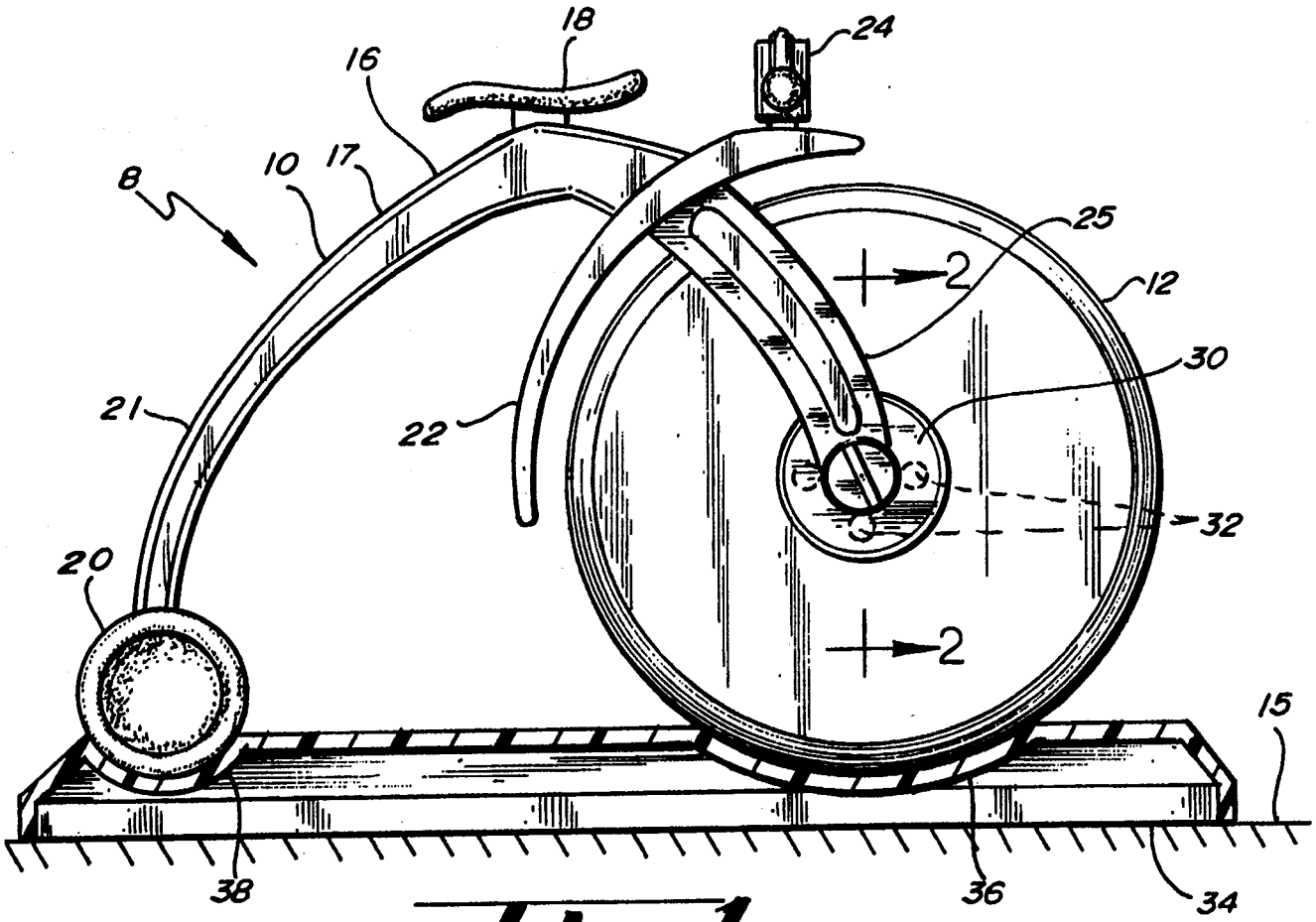
FIG. 1 is a right-side elevation view of the invention.
Figure 3:
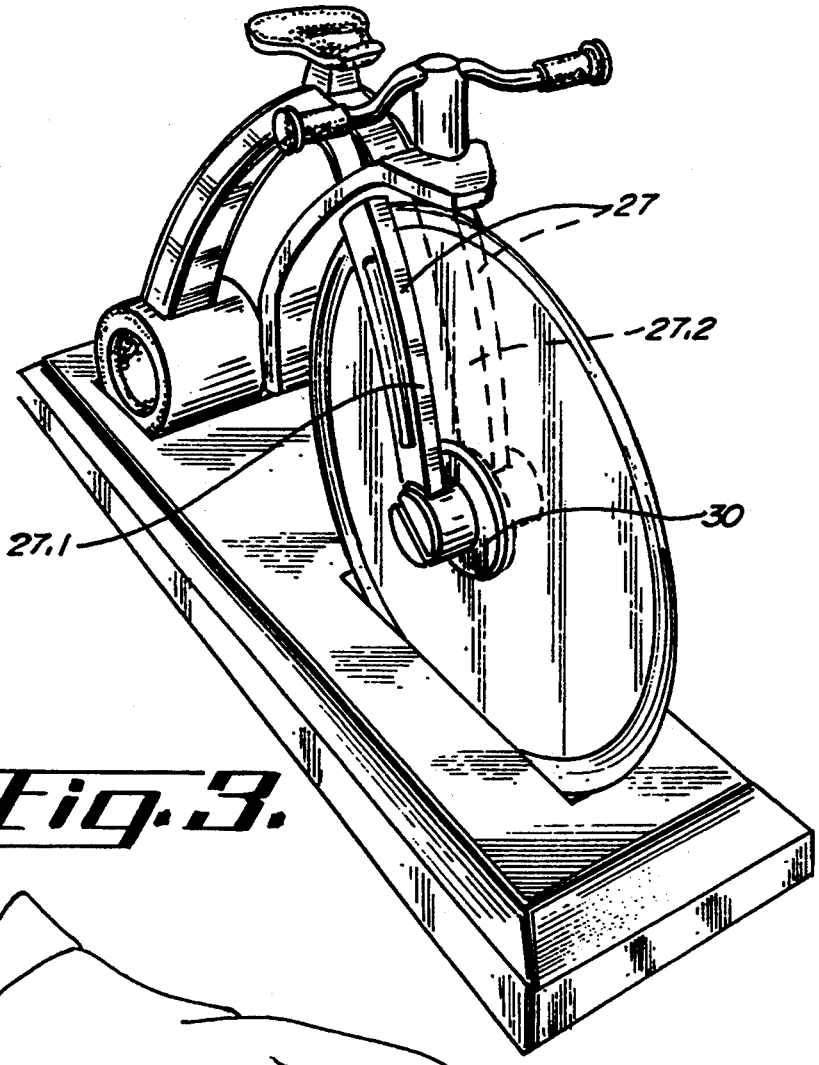
FIG. 3 is a right-side perspective view of the invention.

In this embodiment of the invention the blade 12 is mounted on the front end 25 of the frame 10 by means of an axle 26 inserted through a circular opening 28 in the blade 12, as seen in FIG. 2. The blade 12 may thus rotate freely around the axle 26.

The front end 25 of the frame 10 further comprises a fork 27 between whose tines 27.1, 27.2 the blade 12 is mounted. A hub 30 is attached to the blade 12 around the circular opening 28. The hub 30 rubs against the tines 27.1, 27.2 of the fork 27 as the blade 12 rotates. The close association between the hub 30 and the fork 27 prevents the blade 12 from wobbling from side to side.

The hub 30 is formed around the blade 12 by flowing a moldable material, such as plastic, through the peripheral openings 32 in the circular blade 12 around the circular opening 28.

The pizza cutter is used by gripping the handle 17 with the hand and exerting downward pressure with the thumb 19 against the thumb guide 18, forcing the blade 12 against the surface of the pizza 14. The blade is then drawn forward or backward across the pizza, cutting the pizza. It will be recognized that the angle of the longitudinal axis of the frame 10 relative to the horizontal surface of the pizza 14 can be varied to apply more or less pressure through the blade to the pizza. For example, a relatively large angle can be used when the pizza crust is thick or hard, the pressure of the thumb on the thumb guide thus being more directly applied to the pizza through the blade 12. When less cutting pressure is required the angle would be lower. As seen most clearly in FIG. 4, when the angle is low the arcuate shape of the handle 17 and the presence of the support 20 prevent the hand from contacting the surface of the pizza 14, thus preventing slippery materials from adhering to the handle 17. This is an important safety feature which minimizes the chance of the hand slipping forward and contacting the blade 12.

The fender 22 prevents accidental contact between the fingers and the blade 12 during operation. The thumb guard 24 prevents the thumb from contacting the blade 12 if the thumb should accidentally slip off the thumb guide 18 during operation.

Because the hub 30 presses firmly against the tines 27.1, 27.2, the blade 12 is prevented from wobbling around the axle 26 while still being free to rotate around the axle 26. Constraining the blade from wobbling allows pressure from the hand to be efficiently applied to the pizza through the blade, and allows a very even cut.

In this embodiment of the invention the frame 10, thumb guide 18, support 20, fender 22 and thumb guard 24 are molded as a single unit during the manufacturing process, thus keeping the cost of manufacture low.

This embodiment of the invention also includes a stand 34 having a slot 36 for receiving an arc of the blade 12 and a concavity 38 for receiving the support 20. When not in use the pizza cutter may be conveniently stored on the stand.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A pizza cutter for cutting pizza on a horizontal surface, comprising a circular blade, an arcuate frame having a forward end adapted to rotatably receive said circular blade, said blade thereby being rotatable in a vertical plane, said frame further having an intermediate portion forming a handle for a human hand wherein said intermediate portion further comprises a thumb guide for applying pressure through the blade to the pizza, a thumb guard to prevent the thumb from contacting said blade, and a fender to prevent the fingers from contacting said blade, and said frame further having a support at a rearward end for supporting the pizza cutter in a vertical resting position on a horizontal surface when not in use.

2. The pizza cutter of claim 1, wherein said support further functions as a shield for preventing the hand from contacting the pizza.

3. The pizza cutter of claim 1, wherein said support is a cylinder with axis perpendicular to a longitudinal axis of said frame.

4. The pizza cutter of claim 1, wherein said frame, said thumb guide, said thumb guard, said fender and said support are integrally molded as a single article.

5. The pizza cutter of claim 1, wherein said forward end further comprises a fork, said circular blade has a circular opening through its center, and said circular blade is mounted between tines of said fork by an axle inserted through said circular opening.

6. The pizza cutter of claim 5, wherein a hub is mounted at the periphery of said circular opening and said hub abuts the tines of said fork, thereby limiting lateral motion of said blade around said axle.

7. The pizza cutter of claim 6, wherein said circular blade has a plurality of peripheral openings around said circular opening and said hub is formed by flowing a moldable material through said peripheral openings.

8. The pizza cutter of claim 1, further comprising a stand having a slot for receiving said blade and a depression for receiving said support, the stand thereby supporting the pizza cutter in a vertical position on a horizontal surface.

9. A pizza cutter for cutting pizza on a horizontal surface, comprising:

a circular blade with a circular opening through its center and a plurality of peripheral openings around said circular opening, an arcuate frame having a fork at the forward end adapted to rotatably receive said circular blade, said circular blade being mounted between tines of said fork by an axle inserted through said circular opening, said blade thereby being rotatable in a vertical plane, said circular blade having a hub mounted at the periphery of said circular opening, said hub abutting the tines of said fork, thereby limiting lateral motion of said blade around said axle, said frame having an intermediate portion forming a handle for a human hand, said intermediate portion further comprising a thumb guide for applying pressure to the pizza, a thumb guard to prevent the thumb from contacting said blade, and a fender to prevent the fingers from contacting said blade, said frame having a support at a rearward end for supporting the pizza cutter in a vertical resting position on a horizontal surface when not in use, said support also functioning as a shield for preventing the hand from contacting the pizza, and said frame, said thumb guide, said thumb guard, said fender and said support being integrally molded as a single article.

10. The pizza cutter of claim 9, wherein said support is a cylinder with axis perpendicular to a longitudinal axis of said frame.

11. The pizza cutter of claim 9, wherein said hub is formed by flowing a moldable material through said peripheral openings.

12. The pizza cutter of claim 9 further comprising a stand having a slot for receiving said blade and a depression for receiving said support, the stand thereby supporting the pizza cutter in a vertical position on a horizontal surface.

13. A pizza cutter for cutting pizza on a horizontal surface, comprising a circular blade, an arcuate frame having a forward end adapted to rotatably receive said circular blade, said blade thereby being rotatable in a vertical plane, said frame further having an intermediate portion forming a handle for a human hand, said frame further having a support at a rearward end for supporting the pizza cutter in a vertical resting position on a horizontal surface when not in use, and a stand having a slot for receiving said blade and a depression for receiving said support, the stand thereby supporting the pizza cutter in a vertical position on a horizontal surface.

14. The pizza cutter of claim 13, wherein said support is a cylinder with axis perpendicular to a longitudinal axis of said frame.

15. The pizza cutter of claim 13, wherein said intermediate portion further comprises a thumb guide for applying pressure through the blade to the pizza, a thumb guard to prevent the thumb from contacting said blade, and a fender to prevent the fingers from contacting said blade.

16. The pizza cutter of claim 15, wherein said frame, said thumb guide, said thumb guard, said fender and said support are integrally molded as a single article.

17. The pizza cutter of claim 13, wherein said forward end further comprises a fork, said circular blade has a circular opening through its center, and said circular blade is mounted between tines of said fork by an axle inserted through said circular opening.

18. The pizza cutter of claim 17, wherein a hub is mounted at the periphery of said circular opening and said hub abuts the tines of said fork, thereby limiting lateral motion of said blade around said axle.

19. The pizza cutter of claim 18, wherein said circular blade has a plurality of peripheral openings around said circular opening and said hub is formed by flowing a moldable material through said peripheral openings.

* * * * *